United States Patent [19]

Harbulak

[11] 4,036,709

[45] July 19, 1977

[54] ELECTROPLATING NICKEL, COBALT, NICKEL-COBALT ALLOYS AND BINARY OR TERNARY ALLOYS OF NICKEL, COBALT AND IRON

[75] Inventor: Edward P. Harbulak, Allen Park, Mich.

[73] Assignee: M & T Chemicals Inc., Greenwich, Conn.

[21] Appl. No.: 741,710

[22] Filed: Nov. 15, 1976

Related U.S. Application Data

[63] Continuation of Ser. No. 615,195, Sept. 22, 1975, abandoned.

[51] Int. Cl.[2] ..... C25D 3/12; C25D 3/56

[52] U.S. Cl. ..... 204/43 T; 204/48; 204/49

[58] Field of Search ..... 204/43 T, 48, 49, 112, 204/123; 106/1

[56] References Cited

U.S. PATENT DOCUMENTS

| | | | |
|---|---|---|---|
| 2,208,657 | 7/1940 | Ballay | 204/49 |
| 3,795,591 | 3/1974 | Clauss et al. | 204/43 T |

FOREIGN PATENT DOCUMENTS

| | | | |
|---|---|---|---|
| 920,922 | 3/1963 | United Kingdom | 204/49 |
| 932,843 | 7/1963 | United Kingdom | 204/49 |

OTHER PUBLICATIONS

A. Jogarao et al., Metal Finishing, pp. 82–84, Jan. 1966.
Abner Brenner, "Electrodeposition of Alloys", vol. II, p. 239, (1963).
J. K. Dennis et al., "Nickel and Chromium Plating", pp. 140–141, (1972).

*Primary Examiner*—G. L. Kaplan
*Attorney, Agent, or Firm*—Kenneth G. Wheeless; Robert P. Auber; Robert Spector

[57] ABSTRACT

This invention relates to a process and composition for the preparation of an electrodeposit which contains; at least one metal selected from the group consisting of nickel and cobalt or; binary or ternary alloys of the metals selected from nickel, iron, and cobalt; which comprises passing current from an anode to a cathode through an aqueous acidic electroplating solution containing at least one member selected from nickel compounds and cobalt compounds and which may additionally contain iron compounds providing nickel, cobalt and iron ions for electrodepositing nickel, cobalt, nickel-cobalt alloys, nickel-iron alloys, cobalt-iron alloys or nickel-iron-cobalt alloys and containing an effective amount of at least one additive; the improvement comprising the presence of 10 micromoles per liter to 2000 micromoles per liter of an organic disulfide compound or salt thereof having the formula:

$$R_1—S—S—R_2$$

wherein $R_1$ and $R_2$ are independently selected from

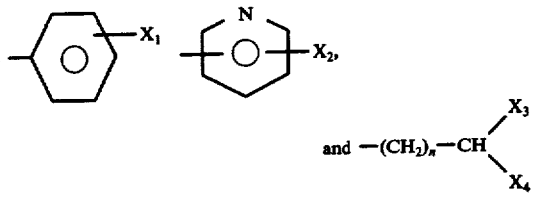

where $n$ is an integer from 0 to 5, $X_1$ is selected from —OH, —$NH_2$,

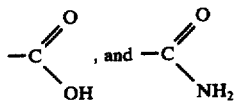

or salts thereof and $X_2$, $X_3$ and $X_4$ are independently selected from —H, —OH, —$NH_2$,

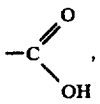

and

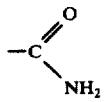

or salts thereof, provided that $X_3$ and $X_4$ are not simultaneously hydrogen; for a time period sufficient to form a metal electroplate upon said cathode.

14 Claims, No Drawings

ELECTROPLATING NICKEL, COBALT, NICKEL-COBALT ALLOYS AND BINARY OR TERNARY ALLOYS OF NICKEL, COBALT AND IRON

This is a continuation of application Ser. No. 615,195, filed Sept. 22, 1975, now abandoned.

BACKGROUND OF THE INVENTION

An important consideration in the commercial electroplating of bright nickel at the present time and for the forseeable future is minimizing the cost of depositing nickel and conserving the nickel metal itself, which is not an unlimited resource, and often in short supply or available only at high cost. To conserve nickel and reduce costs a number of procedures have been tried by the nickel plating industry. One of the earliest approaches to the problem was to reduce the thickness of nickel deposited. However, in order to retain the degree of brightening and leveling to which the nickel plating industry has grown accustomed, it is necessary to use more effective or "powerful" nickel brighteners or higher concentrations of nickel brighteners, so that a bright and well-leveled nickel deposit might be obtained with the thinner deposits. The more "powerful" nickel brighteners or high concentrations of brighteners, while capable of producing the desired brightening and leveling, may nevertheless cause unacceptable side effects. The nickel deposits may be highly stressed, severely embrittled, less receptive to subsequent chromium deposits or exhibit hazes, reduced low current density covering power or "throw" or striations and skip plate, i.e., areas in which a deposit is not obtained.

Another method of saving nickel has been to substitute cobalt for some portion of the nickel, and thereby deposit nickel-cobalt alloys. Generally, cobalt is more expensive than nickel, but at times cobalt may be more readily available than nickel. If thinner deposits of nickel-cobalt alloys are then deposited in order to reduce costs, but higher concentrations of brighteners, or more "powerful" brighteners are employed in the plating bath to retain the desired degree of brightening and leveling, the same problems mentioned previously with respect to nickel plating may become manifest; that is, the deposits may be highly stressed, severely embrittled, hazy, striated, etc.

More recently, electrodeposited alloys of nickel-iron, nickel-cobalt-iron or cobalt-iron have begun to be used commercially as substitutes for decorative nickel electrodeposits in periods when nickel has been in short supply or to reduce the cost of nickel electrodeposits by substituting relatively inexpensive iron for a portion of the more expensive nickel and/or cobalt. Electrodeposited alloys containing as much as 60% by weight iron (with the remainder predominantly nickel and/or cobalt) are thus being used commercially in applications where formerly all nickel electrodeposits were considered necessary.

Although in many respects, the electrodeposition of nickel-iron, cobalt-iron or nickel-cobalt-iron alloys is very similar to the electrodeposition of nickel in that similar equipment, operating conditions and organic additives are employed; nevertheless, electroplating with iron containing alloys of nickels and/or cobalt presents some special problems. For example, in order to maintain the desired ratio of nickel or cobalt ions to iron ions in the electroplating solution, a portion of the nickel or cobalt anodes are desirably replaced with iron anodes to provide ferrous ions to the plating solution as a replenishment for the iron plated out of the bath. These iron anodes should corrode evenly, smoothly and efficiently to avoid anode polarization, as well as to preclude the sloughing off of particles of the iron anodes thereby clogging anode bags and filters or causing rough deposits. Since the introduction of undesirable foreign materials to a plating bath must always be guarded against, the iron anodes should be of high purity. Unfortunately, iron of suitable purity for use as anodes in an iron alloy bath may not corrode evenly in the bath and can result in the aforementioned problems.

Another requirement in the electrodeposition of iron alloys of nickel and/or cobalt is that the iron in the electroplating solution should be predominantly in the ferrous state rather than the ferric. At a pH of about 3.5, basic ferric salts precipitate and can clog the anode bags and filters and may produce rough electrodeposits. It is, therefore, advantageous to prevent any ferric basic salts from precipitating. This can be accomplished by the addition of suitable complexing, chelating, anti-oxidant or reducing agents to the iron containing electroplating alloy bath as taught by Koretzky in U.S. Pat. No. 3,354,059; Passal in U.S. Pat. No. 3,804,726; or Clauss et al. in U.S. Pat. No. 3,806,429. While these complexing or chelating agents are necessary in order to provide a solution to the ferric iron problem, their use may result in several undesirable side effects. They can cause a reduction in deposit leveling and can also produce striated, hazy or dull deposits which may further exhibit step plate or even skip plate, i.e., areas which are not plated, or else plated only very thinly compared to other sections of the deposits.

OBJECT OF THE INVENTION

It is an object of this invention to provide processes and compositions for depositing electrodeposits of nickel, cobalt, or binary or ternary alloys of the metals selected from nickel, cobalt and iron which possess a greater tolerance for high concentrations of brighteners. It is a further object of this invention to provide deposits of nickel, cobalt or binary or ternary alloys of the metals selected from nickel, cobalt and iron characterized by increased ductility, brightness, covering power, and leveling or scratch hiding ability. It is a further object of this invention to provide for more uniform corrosion or dissolution of iron anodes in iron containing alloy electroplating baths of nickel, cobalt or nickel and cobalt. Other objects of this invention will be apparent from the following detailed description of this invention.

DESCRIPTION OF THE INVENTION

In accordance with certain of its aspects, this invention relates to a process for the preparation of an electrodeposit which contains at least one metal selected from the group consisting of nickel and cobalt and which may also contain iron, which comprises passing current through an aqueous, acidic plating solution containing at least one member selected from the group consisting of nickel compounds and cobalt compounds, and which may also contain iron compounds to provide nickel, cobalt and iron ions for electrodepositing nickel, cobalt, or binary or ternary alloys of nickel, cobalt and iron; the improvement comprising the presence of 10 micromoles per liter to 2000 micromoles per liter of an organic disulfide compound or salt thereof having the formula:

$$R_1—S—S—R_2$$

wherein $R_1$ and $R_2$ are independently selected from

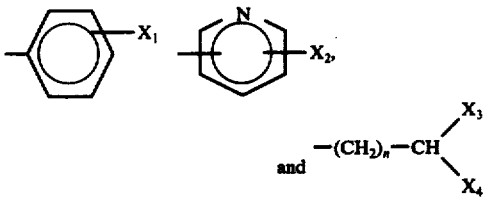

where $n$ is an integer from 0 to 5, $X_1$ is selected from —OH, —$NH_2$;

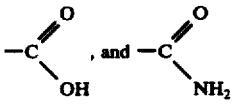

or salts thereof and $X_2$, $X_3$ and $X_4$ are independently selected from —H, —OH, —$NH_2$,

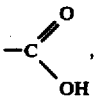

and

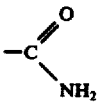

or salts thereof, provided that $X_3$ and $X_4$ are not simultaneously hydrogen; for a time period sufficient to form a metal electroplate upon said cathode.

The baths of this invention may also contain an effective amount of at least one member selected from the group consisting of:

a. Class I brighteners
b. Class II brighteners
c. Anti-pitting or wetting agents The term "Class I Brighteners" as used herein, and as described in *Modern Electroplating*, Third Edition, F. Lowenheim, Editor, is meant to include aromatic sulfonates, sulfonamides sulfonimides, sulfinates, etc., as well as aliphatic or aromatic-aliphatic olefinically or acetylenically unsaturated sulfonates, sulfonamides, sulfonimides, etc. Specific examples of such plating additives are:

1. sodium o-sulfobenzimide
2. disodium 1,5-naphthalene disulfonate
3. trisodium 1,3,6-naphthalene trisulfonate
4. sodium benzene monosulfonate
5. dibenzene sulfonimide
6. sodium benzene monosulfinate
7. sodium alkyl sulfonate
8. sodium 3-chloro-2-butene-1-sulfonate
9. sodium β-styrene sulfonate
10. sodium propargyl sulfonate
11. monoallyl sulfamide
12. diallyl sulfamide
13. allyl sulfonamide Such plating additive compounds, which may be used singly or in suitable combinations, are desirably employed in amounts ranging from about 0.5 to 10 grams per liter and have one or more of the following functions:

1. To obtain semi-lustrous deposits or to produce substantial grain-refinement over the usual dull, matte, grainy, non-reflective deposits from additive free baths.
2. To act as ductilizing agents when used in combination with other additives such as Class II brighteners.
3. To control internal stress of deposits, generally by making the stress desirably compressive.
4. To introduce controlled sulfur contents into the electrodeposits to desirably affect chemical reactivity, potential differences in composite coating systems, etc. thereby decreasing corrosion, better protecting the basis metal from corrosion, etc.
5. They may act to prevent or minimize pitting.
6. They may condition the cathode surface by catalytic poisoning, etc. so that the rates of consumption of cooperating additives (usually of the Class II brightener type) may be substantially reduced, making for better economy of operation and control.

The term "Class II brighteners" as used herein, and as described in *Modern Electroplating*, Third Edition, F. Lowenheim, Editor, is meant to include plating additive compounds such as reaction products of epoxides with alpha-hydroxy acetylenic alcohols such as diethoxylated 2-butyne-1, 4-diol or dipropoxylated 2-butyne-1,4-diol, other acetylenics, N-heterocyclics, active sulfur compounds, dye-stuffs, etc. Specific examples of such plating additives are:

1. 1,4-di-(β-hydroxyethoxy)-2-butyne
2 1,4-di-(β-hydroxy-γ-chloropropoxy)-2-butyne
3 1,4-di-(β-,γ-epoxypropoxy)-2-butyne
4 1,4-di-(β-hydroxy-γ-butenoxy)-2-butyne
5 1,4-di-(2'-hydroxy-4'-oxa-6'-heptenoxy)-2-butyne
6 N-(2,3-dichloro-2-propenyl)-pyridinium chloride
7 2,4,6-trimethyl N-propargyl pyridinium bromide
8 N-allylquinaldinium bromide
9. 2-butyne-1,4-diol
10. propargyl alcohol
11. 2-methyl-3-butyn-2-ol
12. quinaldyl-N-propanesulfonic acid betaine
13. quinaldine dimethyl sulfate
14. N-allypyridinium bromide
15. isoquinaldyl-N-propanesulfonic acid betaine
16. isoquinaldine dimethyl sulfate
17. N-allylisoquinaldine bromide
18 disulfonated 1,4-di(β-hydroxyethoxy)-2-butyne
19. 1-(β-hydroxyethoxy)-2-propyne
20. 1-(β-hydroxypropoxy)-2-propyne
21. sulfonated 1-(β-hydroxyethoxy)-2-propyne
22. phenosafranin
23. fuchsin When used alone or in combination, desirably in amounts ranging from about 5 to 1000 milligrams per liter, a Class II brightener may produce no visual effect on the electrodeposit, or may produce semi-lustrous, fine-grained deposits. However, best results are obtained when Class II brighteners are used with one or more Class I brighteners in order to provide optimum deposit luster, rate of brightening, leveling, bright plate current density range, low current density coverage, etc.

The term "anti-pitting or wetting agents" as used herein is meant to include a material which functions to prevent or minimize gas pitting. An anti-pitting agent, when used alone or in combination, desirably in amounts ranging from about 0.05 to 1 gram per liter, may also function to make the baths more compatible with contaminants such as oil, grease, etc. by their emulsifying, dispersing, solubilizing, etc. action on such contaminants and thereby promote attaining of sounder deposits. Preferred anti-pitting agents may include sodium lauryl sulfate, sodium lauryl ether-sulfate and sodium di-alkylsulfosuccinates.

The nickel compounds, cobalt compounds and iron compounds employed to provide nickel, cobalt and iron ions for electrodepositing nickel, cobalt, or binary or ternary alloys of nickel, cobalt and iron, (such as nickel-cobalt, nickel-iron, cobalt-iron and nickel-cobalt-iron alloys) are typically added as the sulfate, chloride, sulfamate or fluoborate salts. The sulfate, chloride, sulfamate or fluoborate salts of nickel or cobalt are employed in concentrations sufficient to provide nickel and/or cobalt ions in the electroplating solutions of this invention in concentrations ranging from about 10 to 150 grams per liter. The iron compounds, such as the sulfate, chloride, etc. when added to the nickel, cobalt, or nickel and cobalt containing electroplating solutions of this invention, are employed in concentrations sufficient to provide iron ions ranging in concentration from about 0.25 to 25 grams per liter. The ratio of nickel ions or cobalt ions or nickel and cobalt ions to iron ions may range from about 50 to 1 to about 5 to 1.

The iron ions in the electroplating solutions of this invention may also be introduced through the use of iron anodes, rather than through the addition of iron compounds. Thus, for example, if some percentage of the total anode area in a nickel electroplating bath is composed of iron anodes, after some period of electrolysis enough iron will have been introduced into the bath by chemical or electrochemical dissolution of the iron anodes to provide the desired concentration of iron ions.

The nickel, cobalt, nickel-cobalt, nickel-iron, cobalt-iron and nickel-cobalt-iron electroplating baths of this invention additionally may contain from about 30 to 60 grams per liter, preferably about 45 grams per liter of boric acid or other buffering agents to control the pH (e.g. from about 2.5 to 5, preferably about 3 to 4) and to prevent high current density burning.

When iron ions are present in the plating baths of this invention, the inclusion of one or more iron complexing, chelating, anti-oxidizing, reducing, or other iron solubilizing agents such as citric, malic, glutaric, gluconic, ascorbic, isoascorbic, muconic, glutamic, glycollic, and aspartic acids or similar acids or their salts are desirable in the iron containing baths to solubilize iron ions. These iron complexing or solubilizing agents may range in concentration in the plating solution from about one gram per liter to about 100 grams per liter, depending, of course, on how much iron is present in the plating bath.

In order to prevent "burning" of high current density areas, provide for more even temperature control of the solution, and control the amount of iron in the iron containing alloy deposits, solution agitation may be employed. Air agitation, mechanical stirring, pumping, cathode rod and other means of solution agitation are all satisfactory. Additionally, the bath may be operated without agitation.

The operating temperature of the electroplating baths of this invention may range from about 45° C to about 85° C, preferably from about 50° C to 70°.

The average cathode current density may range from about 0.5 to 12 amperes per square decimeter, with 3 to 6 amperes per square decimeter providing an optimum range.

Typical aqueous nickel-containing electroplating baths (which may be used in combination with effective amounts of cooperating additives) include the following wherein all concentrations are in grams per liter (g/l) unless otherwise indicated:

TABLE I

AQUEOUS NICKEL-CONTAINING ELECTROPLATING BATHS

| | Minimum | Maximum | Preferred |
|---|---|---|---|
| Component: | | | |
| $NiSO_4 \cdot 6H_2O$ | 75 | 500 | 300 |
| $NiCl_2 \cdot 6H_2O$ | 20 | 100 | 60 |
| $H_3BO_3$ | 30 | 60 | 45 |
| pH (electrometric) | 3 | 5 | 4 |

When ferrous sulfate ($FeSO_4 \cdot 7H_2O$) is included in the foregoing bath the concentration is about 2.5 grams per liter to about 125 grams per liter.

Typical sulfamate-type nickel plating baths which may be used in the practice of this invention may include the following components:

TABLE II

| | Minimum | Maximum | Preferred |
|---|---|---|---|
| Component: | | | |
| Nickel Sulfamate | 100 | 500 | 375 |
| $NiCl_2 \cdot 6H_2O$ | 10 | 100 | 60 |
| $H_3BO_3$ | 30 | 60 | 45 |
| pH (Electrometric) | 3 | 5 | 4 |

When ferrous sulfate ($FeSO_4 \cdot 7H_2O$) is included in the foregoing bath the concentration is about 2.5 grams per liter to about 125 grams per liter.

Typical chloride-free sulfate-type nickel plating baths which may be used in the practice of this invention may include the following components:

TABLE III

| | Minimum | Maximum | Preferred |
|---|---|---|---|
| Component: | | | |
| $NiSO_4 \cdot 6H_2O$ | 100 | 500 | 300 |
| $H_3BO_3$ | 30 | 60 | 45 |
| pH (Electrometric) | 2.5 | 4 | 3-3.5 |

When ferrous sulfate ($FeSO_4 \cdot 7H_2O$) is included in the foregoing baths the concentration is about 2.5 grams per liter to about 125 grams per liter.

Typical chloride-free sulfamate-type nickel plating baths which may be used in the practice of this invention may include the following components:

TABLE IV

| | Minimum | Maximum | Preferred |
|---|---|---|---|
| Component: | | | |
| Nickel sulfamate | 200 | 500 | 350 |
| $H_3BO_3$ | 30 | 60 | 45 |
| pH (Electrometric) | 2.5 | 4 | 3-3.5 |

When ferrous sulfate ($FeSO_4 \cdot 7H_2O$) is included in the foregoing baths the concentration is about 2.5 grams per liter to about 125 grams per liter.

The following are aqueous cobalt-containing and cobalt-nickel-containing electroplating baths which may be used in the practice of this invention:

TABLE V

AQUEOUS COBALT-CONTAINING AND COBALT NICKEL-CONTAINING ELECTROPLATING BATHS
(All concentrations in g/l unless otherwise noted)

| | Minimum | Maximum | Preferred |
|---|---|---|---|
| Cobalt bath | | | |
| $CoSO_4 \cdot 7H_2O$ | 50 | 500 | 300 |
| $CoCl_2 \cdot 6H_2O$ | 15 | 125 | 60 |
| H | 30 | 60 | 45 |
| Cobalt bath | | | |
| $CoSO_4 \cdot 7H_2O$ | 100 | 500 | 400 |
| NaCl | 15 | 60 | 30 |
| $H_3BO_3$ | 30 | 60 | 45 |
| High chloride cobalt bath | | | |
| $CoSO_4 \cdot 7H_2O$ | 75 | 350 | 225 |
| $CoCl_2 \cdot 6H_2O$ | 50 | 350 | 225 |
| $H_3BO_3$ | 30 | 60 | 45 |
| Cobalt-nickel alloy bath | | | |
| $NiSO_4 \cdot 6H_2O$ | 75 | 400 | 300 |
| $CoSO_4 \cdot 7H_2O$ | 15 | 300 | 80 |
| $NiCl_2 \cdot 6H_2O$ | 15 | 75 | 60 |
| $H_3BO_3$ | 30 | 60 | 45 |
| All-chloride cobalt bath | | | |
| $CoCl_2 \cdot 6H_2O$ | 100 | 500 | 300 |
| $H_3BO_3$ | 30 | 60 | 45 |
| Sulfamate cobalt bath | | | |
| Cobalt sulfamate | 100 | 400 | 290 |
| $CoCl_2 \cdot 6H_2O$ | 15 | 75 | 60 |
| $H_3BO_3$ | 30 | 60 | 45 |

The pH in the typical formulations of Table V may range from about 3 to 5 with 4 preferred.

When ferrous sulfate ($FeSO_4.7H_2O$) is included in the foregoing baths the concentration is about 2.5 grams per liter to 125 grams per liter.

Typical nickel-iron containing electroplating baths which may be used in the practice of this invention may include the following components:

TABLE VI

| | Minimum | Maximum | Preferred |
|---|---|---|---|
| Component: | | | |
| $NiSO_4 \cdot 6H_2O$ | 20 | 500 | 200 |
| $NiCl_2 \cdot 6H_2O$ | 15 | 300 | 60 |
| $FeSO_4 \cdot 7H_2O$ | 1 | 125 | 40 |
| $H_3BO_3$ | 30 | 60 | 45 |
| pH (Electrometric) | 2.5 | 5 | 3.5–4 |

With the inclusion of ferrous sulfate ($FeSO_4.7H_2O$) in the foregoing bath formulations it is desirable to additionally include one or more iron complexing, chelating or solubilizing agents ranging in concentration from about 1 gram per liter to about 100 grams per liter, depending, of course, on the actual iron concentration.

It will be apparent that the above baths may contain compounds in amounts falling outside the preferred minimum and maximum set forth, but most satisfactory and economical operation may normally be effected when the compounds are present in the baths in the amounts indicated. A particular advantage of the chloride-free baths of Tables III and IV, supra, is that the deposits obtained may be substantially free of tensile stress and may permit high speed plating involving the use of "high speed" anodes.

The pH of all of the foregoing illustrative aqueous nickel-containing, cobalt-containing, nickel-cobalt-containing, nickel-iron, cobalt-iron and nickel-cobalt-iron-containing compositions may be maintained during plating at pH values of 2.5 to 5.0, and preferably from about 3.0 to 4.0. During bath operation, the pH may normally tend to rise and may be adjusted with acids such as hydrochloric acid, sulfuric acid, etc.

Anodes used in the above baths may consist of the particular single metal being plated at the cathode such as nickel or cobalt for plating nickel or cobalt respectively. For plating binary or ternary alloys such as nickel-cobalt, cobalt-iron, nickel-iron or nickel-cobalt-iron, the anodes may consist of the separate metals involved suitable suspended in the bath as bars, strips or small chunks in titanium baskets. In such cases the ratio of the separate metal anode areas is adjusted to correspond to the particular cathode alloy composition desired. For plating binary or ternary alloys one may also use as anodes alloys of the metals involved in such a percent weight ratio of the separate metals as to correspond to the percent weight ratio of the same metals in the cathode alloy deposits desired. These two types of anode systems will generally result in a fairly constant bath metal ion concentration for the respective metals. If with fixed metal ratio alloy anodes there does occur some bath ion imbalance, occasional adjustments may be made by adding the appropriate corrective concentration of the individual metal salts. All anodes are usually suitably covered with cloth or plastic bags of desired porosity to minimize introduction into the bath of metal particles, anode slime, etc. which may migrate to the cathode either mechanically or electrophoretically to give roughness in cathode deposits.

The substrates on which the nickel-containing, cobalt-containing, nickel-cobalt-containing, nickel-iron-containing, cobalt-iron-containing or nickel-cobalt-iron-containing electrodeposits of this invention may be applied may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as steel, copper, tin and alloys thereof such as with lead, alloys of copper such as brass, bronze, etc., zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the cobalt, nickel, or iron containing electroplate applied on such substrates.

While nickel, cobalt, nickel-cobalt, nickel-iron, cobalt-iron or nickel-iron-cobalt electrodeposits can be obtained employing the various parameters described above, the brightness, leveling, ductility and covering power may not be sufficient or satisfactory for a particular application. In addition, the deposit may be hazy or dull, and also exhibit striations and step plate. These conditions may especially result after the addition of excessive replenishment amounts of Class II brighteners, or from the use of especially "powerful" Class II brighteners. In the case of the iron-containing plating baths which additionally contain iron solubilizing agents, the solubilizing agents may also cause a loss of leveling and brightness, or may result in hazy, dull or striated deposits. I have discovered that the addition or inclusion of certain bath compatible disulfide compounds to an aqueous acidic nickel, cobalt, nickel-cobalt, nickel-iron, cobalt-iron or nickel-iron-cobalt electroplating bath will correct the aforementioned deficiencies. Additionally, the disulfide compounds of this invention permit the use of higher than normal concentrations of Class II brighteners, thus permitting higher rates of brightening and leveling without the undesirable striations, skip plate, brittleness, etc. normally expected under these conditions. In addition, in those electroplating baths employing iron anodes, the disulfide compounds of this invention also provide for improved iron anode corrosion or dissolution. These bath soluble disulfide compounds are exemplified by the following generalized formula:

$HO-(CH_2)_2-S-S-(CH_2)_2-OH$ 2,2'-dithiodiethanol

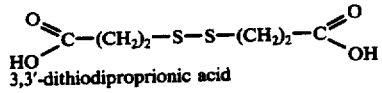

3,3'-dithiodiproprionic acid $H_2N-(CH_2)_2-S-S-(CH_2)_2-NH_2$ cystamine

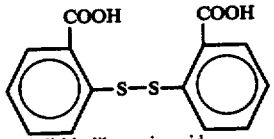

2,2'-dithiodibenzoic acid

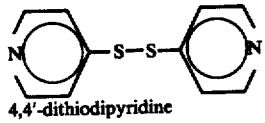

4,4'-dithiodipyridine $R_1-S-S-R_2$ where $R_1$ and $R_2$ are independently selected from

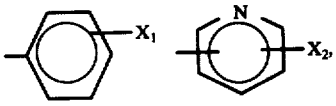

and $-(CH_2)_n-CH(X_3)(X_4)$ where $n$ is an integer from 0 to 5, $X_1$ is selected from —OH, $-NH_2$,

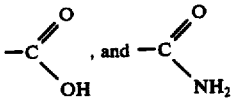

and $X_2$, $X_3$ and $X_4$ are independently selected from —H, —OH, $-NH_2$,

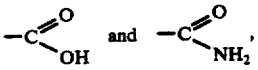

and provided that $X_3$ and $X_4$ are not simultaneously hydrogen. It will be appreciated that quaternary salts of the amine groups or salts or esters of the carboxylic acid groups may also be successfully employed. For example, the hydrochloride or hydrosulfate salts of the amine functions can improve the solubility of the parent compound, while the ammonium, lithium, potassium, sodium and similar salts of the carboxy acids with bath compatible cations may also be advantageously employed while the simple esters (e.g., methyl, ethyl, etc.) of the acids hydrolyze in the plating bath to give the parent acid.

Typical or representative compounds which are characterized by the above generalized formula are listed but not limited to the following:

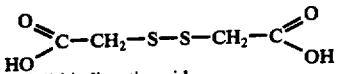

2,2'-dithiodiacetic acid

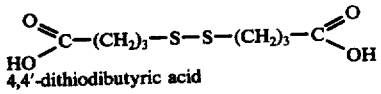

4,4'-dithiodibutyric acid

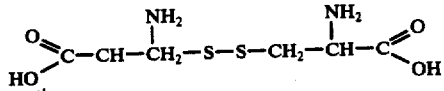

cystine

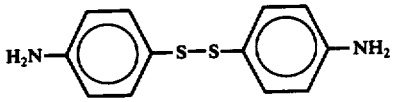

4,4'-dithiodianiline

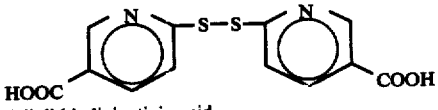

6,6'-dithiodinicotinic acid

The above compounds or salts or esters thereof are additionally advantageous in that they are commercially available; and thus, complex, difficult or dangerous syntheses need not be carried out in order to obtain these materials.

The use of sulfide compounds of the type $NC-(CH_2)_n-S-(CH_2)_n-CN$ where $n$ is an integer from 1 to 4, have been shown by DuRose in U.S. Pat. No. 2,978,391 to be useful brighteners in nickel electroplating baths. However, it has been found that monosulfide compounds of this type are undesirable in a nickel-iron, cobalt-iron or nickel-iron-cobalt electroplating bath because even at concentrations as low as 0.005 g/l they severely embrittle the deposit, produce iridescent medium and low current density hazes, cause the deposit to be dark in color and also cause the plating solution to be extremely sensitive to agitation. The monosulfides as well as similar compounds containing the mercapto (—SH) group have also been found to cause exfoliation of nickel-iron, cobalt-iron and nickel-iron-cobalt deposits from the basis metal. The disulfide compounds of this invention, quite unexpectedly, produce just the opposite effects when added to nickel, cobalt, nickel-iron, cobalt-iron or nickel-iron-cobalt electroplating baths, i.e., they eliminate medium and low current density hazes, improve the deposit coverage or throwing power (that is, extend the low current density plating range), and increase the deposit ductility.

Clauss et al in U.S. Pat. No. 3,795,591 claim the use of compounds containing a sulfide and a sulfonate group in the same molecule to extend the current density range of a nickel-iron electroplating bath. The sulfonate group is thought to play an essential role in making these sulfide compounds useful additives, as indeed sulfonate groups have been found to be essential to bright nickel plating in general, (see *Modern Electroplating*, Third Edition, pp. 297–306). It was, therefore, most unexpected and surprising to find that the disulfide compounds of this invention, which additionally contain carboxylic acid, hydroxy, amine and amide groups function in such a superior and beneficial manner to the sulfides of the prior art and yet do not contain the sulfonic acid moiety which heretofore appears to have been an essential component of nickel, cobalt and nickel-iron alloy electroplating additives.

The disulfide compounds of this invention are unusual in that they do not act as brighteners per se in the same way as brighteners of the first or second class and therefore should not be thought of as brighteners, but rather as addition agents whose function in the bath is to overcome haze, striation and skip plate. Finally, these materials promote improved corrosion of iron anodes and thereby reduce the propensity for clogged anode bags and filters and rough deposits.

The disulfide compounds of this invenion are employed in the electroplating baths of this invention at concentrations of from about 10 micromoles per liter to 2000 micromoles per liter and preferably from about 20 micromoles per liter to 1000 micromoles per liter.

The following examples are presented as an illustration to provide those skilled in the art of electroplating a better understanding of the various embodiments and aspects of this invention. These examples should not be construed as limiting the scope of the invention in any way.

EXAMPLE 1

An aqueous nickel electroplating bath was prepared having the following composition:

| | Composition in g/l |
|---|---|
| $NiSO_4 \cdot 6H_2O$ | 300 |
| $NiCl_2 \cdot 6H_2O$ | 60 |
| $H_3BO_3$ | 45 |
| Sodium 1,5-naphthalene disulfonate | 4 |
| 1-(β-hydroxyethoxy)-2-propyne | 0.3 |
| pH | 3.7 |
| Temperature | 55° C. |

A polished brass panel was scribed with a horizontal single pass of 4/0 grit emery polishing paper to give a band about 1 cm wide at a distance of about 2.5 cm from and parallel to the bottom edge of the panel. The cleaned panel was then plated in a 267 ml Hull Cell, using the above solution, for 10 minutes at 2 amperes cell current, using magnetic stirring. The resulting test panel was essentially devoid of deposit (i.e., skip plate) in the current density range from zero to about 8.0 amperes per square decimeter (asd) except for a number of scattered "islands" of nickel averaging about 0.5 mm in diameter. From about 8.0 asd to the high current density edge of the panel, the deposit was bright but severely striated.

On adding 415 micromoles per liter (0.1 g/l) of cystine to the plating solution (added as a 25 g/l aqueous solution, prepared by dissolving L(−) Cystine in water with enough dilute sulfuric acid to give the quaternary sulfate salt, thereby increasing the solubility) and repeating the plating test, the resulting nickel deposit was bright and covered the entire test panel. There were no areas of skip plate.

EXAMPLE 2

An aqueous cobalt electroplating bath was prepared having the following composition:

| | Composition in g/l |
|---|---|
| $CoSO_4 \cdot 7H_2O$ | 300 |
| $CoCl_2 \cdot 6H_2O$ | 60 |
| $H_3BO_3$ | 45 |
| Sodium o-sulfobenzimide | 3.6 |
| 1,4-di(β-hydroxyethoxy)-2-butyne | 0.1 |
| pH | 3.6 |
| Temperature | 55° C. |

A polished brass panel was scribed with a horizontal single pass of 4/0 grit emery polishing paper to give a band about 1 cm wide at a distance of about 2.5 cm from and parallel to the bottom edge of the panel. The cleaned panel was then plated in a 267 ml Hull Cell, using the above solution, for 10 minutes at 2 amperes cell current, using magnetic stirring. The resulting cobalt deposit was bright to brilliant across the entire current density range of the test panel except that there was a dense irregular haze extending from the low current density edge of the panel up to about 1.2 asd. In addition, the low current density coverage on the back of the test panel was quite limited and exhibited a sharp line of demarkation between plated and unplated areas.

On adding 70 micromoles per liter (0.02 g/l) of sodium 3,3'-dithiodiproprionate to the plating solution and repeating the plating test, a bright to brilliant deposit was again obtained, except that the dense haze noted above had been completely eliminated. The low current density coverage on the back of the test panel had been greatly extended and covered the entire rear of the test panel and the deposit shaded off gradually without a sharp cut-off.

EXAMPLE 3

An aqueous nickel electroplating bath was prepared having the following composition:

| | Composition in g/l |
|---|---|
| $NiSO_4 \cdot 6H_2O$ | 300 |
| $NiCl_2 \cdot 6H_2O$ | 60 |
| $H_3BO_3$ | 45 |
| Sodium benzenesulfonate | 8 |
| Sodium allyl sulfonate | 3.7 |
| 1-(β-hydroxyethoxy)-2-propyne | 0.1 |
| pH | 3.5 |
| Temperature | 55° C. |

A polished brass panel was scribed with a horizontal single pass of 4/0 grit emery polishing paper to give a band about 1 cm wide at a distance of about 2.5 cm from and parallel to the bottom edge of the panel. The cleaned panel was then plated in a 267 ml Hull Cell, using the above solution, for 10 minutes at 2 amperes cell current, using magnetic stirring. The resulting nickel deposit was brilliant and lustrous, but exhibited severe striations and step plate across the entire current density range of the test panel. In addition, the low current density areas, from 0.05 to about 0.6 asd had areas of skip plate (i.e., no deposit), while the rear of the panel (away from the anode) was completely devoid of deposit.

On adding 137 micromoles per liter (0.025 g/l) of 2,2'-dithiodiacetic acid to the plating solution and repeating the plating test, the resulting nickel deposit was brilliant, lustrous, well leveled and completely free of striations, step plate or skip plate. In addition, the rear of the test panel, representing an extremely low current density region, was completely covered with a sound nickel deposit.

EXAMPLE 4

An aqueous nickel-cobalt electroplating bath was prepared having the following composition:

| | Composition in g/l |
|---|---|
| $NiSO_4 \cdot 6H_2O$ | 240 |
| $NiCl_2 \cdot 6H_2O$ | 48 |
| $CoSO_4 \cdot 7H_2O$ | 60 |
| $CoCl_2 \cdot 6H_2O$ | 12 |
| $H_3BO_3$ | 45 |
| Sodium benzenesulfonate | 12.5 |
| Sodium allyl sulfonate | 4.6 |
| N-(2,3-dichloro-2-propenyl)-pyridinium chloride | 0.096 |
| 2-Methyl-3-butyn-2-ol | 0.083 |
| pH | 2.5 |
| Temperature | 55° C. |

The Hull Cell test procedure and conditions described in Example 1 were employed to obtain a nickel-cobalt alloy deposit from the above solution. The resulting deposit was dark, hazy and thin in the region from about 0.05 asd to about 0.6 asd. From 0.6 asd to the high current density edge of the test panel, the deposit was so severely stressed that the entire deposit was exfoliating from the basis metal. In addition, the back of the test panel, an area of extremely low current density, was practically devoid of a deposit.

On adding 1224 micromoles per liter (0.375 g/l) of 2,2'-dithiodibenzoic acid to the plating solution and repeating the plating test, the resulting nickel-cobalt alloy deposit was sound across the entire current density range of the test panel with no evidence of the stress and deposit exfoliation noted earlier. The back of the test panel was also covered with a deposit of nickel-cobalt.

EXAMPLE 5

An aqueous nickel-cobalt electroplating bath was prepared having the following composition:

| | Composition in g/l |
|---|---|
| $NiSO_4 \cdot 6H_2O$ | 240 |
| $NiCl_2 \cdot 6H_2O$ | 48 |
| $CoSO_4 \cdot 7H_2O$ | 60 |
| $CoCl_2 \cdot 6H_2O$ | 12 |
| $H_3BO_3$ | 45 |
| Sodium o-sulfobenzimide | 1.8 |
| Sodium allyl sulfonate | 4.6 |
| N-(2,3-dichloro-2-propenyl)-pyridinium chloride | 0.048 |
| 2-Methyl-3-butyn-2-ol | 0.042 |
| pH | 3.6 |
| Temperature | 55° C. |

Using the Hull Cell test procedure and conditions described in Example 1, a nickel-cobalt alloy deposit was obtained from the above solution. The deposit was brilliant across the entire current density range of the test panel. However, the deposit in the very low current density areas was rather thin and coverage on the back of the test panel was very poor, while the medium to high current density areas (i.e., about 2 asd and higher) were so highly tensile stressed that the deposit had a network of stress cracks.

On adding 125 micromoles per liter (0.03 g/l) of Cystine to the above solution and repeating the plating test, a brilliant deposit was again obtained, except that the deposit was completely free of stress cracks and the low current density areas, such as the rear of the test panel, were well covered with a sound deposit of nickel-cobalt.

EXAMPLE 6

An aqueous nickel-iron electroplating bath was prepared having the following composition:

| | Composition in g/l |
|---|---|
| $NiSO_4 \cdot 6H_2O$ | 300 |
| $NiCl_2 \cdot 6H_2O$ | 60 |
| $FeSO_4 \cdot 7H_2O$ | 40 |
| $H_3BO_3$ | 45 |
| Sodium iso-ascorbate | 8 |
| Sodium o-sulfobenzimide | 2 |
| Sodium allyl sulfonate | 3.7 |
| 1,4-di(β-hydroxyethoxy)-2-butyne | 0.2 |
| pH | 3.6 |
| Temperature | 55° C. |

A polished brass panel was scribed with a horizontal single pass of 4/0 grit emery polishing paper to give a band about 1 cm wide at a distance of about 2.5 cm from and parallel to the bottom edge of the panel. The cleaned panel was then plated in a 267 ml Hull Cell, using the above solution, for 10 minutes at 2 amperes cell current, using magnetic stirring. The resulting nickel-iron alloy electrodeposit was bright but rather thin and without leveling in the current density range below about 1.2 amperes per square decimeter (asd). The deposit in the region from about 1.2 to 5 asd was badly striated, exhibited step plate, poor leveling, and an iridescent haze, while from about 5 asd to the high current density edge of the test panel, the deposit was brilliant and lustrous with excellent leveling.

On adding 83 micromoles per liter (0.02 g/l) of Cystine to the plating solution (added as a 25 g/l aqueous solution, prepared by dissolving L(−) Cystine in water with enough dilute sulfuric acid to give the quaternary sulfate salt, thereby increasing the solubility) and repeating the plating test, the resulting nickel-iron alloy deposit was brilliant, lustrous and completely free of haze, striations or step plate across the entire current density range of the test panel. In addition, the deposit exhibited good ductility and leveling as evidenced by the degree of obliteration or filling in of the emergy scratches.

EXAMPLE 7

The test conditions and procedures described in Example 6 were repeated except that 89 micromoles per liter (0.02 g/l) of cystamine dihydrochloride were substituted for the cystine. The resulting nickel-iron alloy electrodeposit was essentially the same as obtained in Example 6 when using cystine, except that a slight haze was present at the low current density edge of the test panel.

EXAMPLE 8

The test conditions and procedure described in Example 6 were repeated except the 137 micromoles per liter (0.025 g/l) of 2,2'-dithiodiacetic acid were substituted for the cystine and only 0.1 g/l rather than 0.2 g/l of 1,4-di-(β-hydroxyethoxy)-2-butyne were employed. The resulting nickel-iron alloy deposit was uniformly brilliant, lustrous and free of any haze, striations, step plate, skip plate or thin areas across the entire current density range of the test panel. In addition, the deposit was very ductile and exhibited good leveling.

EXAMPLE 9

An aqueous nickel-iron electroplating bath was prepared having the following composition:

| | Composition in g/l |
|---|---|
| $NiSO_4 \cdot 6H_2O$ | 300 |
| $NiCl_2 \cdot 6H_2O$ | 60 |
| $FeSO_4 \cdot 7H_2O$ | 40 |
| $H_3BO_3$ | 45 |
| Sodium iso-ascorbate | 8 |
| Sodium o-sulfobenzimide | 3.6 |
| Sodium allyl sulfonate | 3.7 |
| 1,4-di-(β-hydroxyethoxy)-2-butyne | 0.1 |
| pH | 3.8 |
| Temperature | 55° C. |

Using the Hull Cell test conditions and procedure described in Example 6, a deposit was obtained from the above solution which was bright but hazy, thin and without leveling in the current density range below about 1.2 asd. The deposit in the region from about 1.2 to 5 and was badly striated, exhibited step plate, poor leveling,and an iridescent haze, while from about 5 asd to the high current density edge of the test panel the deposit was brilliant and lustrous with excellent leveling.

On adding 81 micromoles per liter (0.0125 g/l) of 2,2'-dithiodiethanol to the plating solution and repeating the plating test, the resulting nickel-iron alloy deposit was brilliant and lustrous, free of any striations, step plate, skip plate, or thin areas across the entire current density range of the test panel. Additionally, the deposit possessed excellent ductility, fair leveling and exhibited a faint low current density haze.

The concentration of 1,4-di-(β-hydroxyethoxy)-2-butyne was increased to 0.2 g/l and the above plating test repeated. The resulting nickel-iron alloy electrodeposit was completely brilliant, lustrous and free of haze, striations, step plate, skip plate or thin areas across the entire current density range of the test panel. In addition, the deposit exhibited good leveling, very good ductility and outstanding low current density coverage.

The concentration of the 1,4-di-(β-hydroxyethoxy)-2-butyne was then increased to 0.4 g/l and the plating test again repeated. The results were essentially identical to the results using 0.2 g/l of 1,4-di-(β-hydroxyethoxy)-2-butyne except that the deposit was less ductile. These outstanding results were obtained in spite of the fact that an exceptionally high concentration of Class II brightener (namely 0.4 g/l of 1,4-di-(β-hydroxyethoxy)-2-butyne) as employed in the plating test, which normally would result in a completely unacceptable deposit.

EXAMPLE 10

The test conditions and procedure described in Example 6 were repeated using the bath composition of Example 9 except that 82 micromoles per liter (0.025 g/l) of 2,2'-dithiodibenzoic acid added as an aqueous solution of the sodium salt) were substituted for the 2,2'-dithiodiethanol. The resulting nickel-iron alloy electrodeposit was uniformly brilliant and lustrous, completely free of any haze, striation, step plate or low current density thinness or skip plate and exhibited good leveling and excellent ductility across the entire current density range of the test panel.

The concentration of 1,4-di-(β-hydroxyethoxy)-2-butyne was incresed to 0.2 g/l and the above plating test repeated. The resulting deposit was essentially identical to the one described above, except that the leveling was better while the ductility remained excellent.

EXAMPLE 11

An aqueous nickel-iron electroplating bath was prepared having the following composition:

| | Composition in g/l |
|---|---|
| $NiSO_4 \cdot 6H_2O$ | 300 |
| $NiCl_2 \cdot 6H_2O$ | 60 |
| $FeSO_4 \cdot 7H_2O$ | 40 |
| $H_3BO_3$ | 45 |
| Sodium citrate dihydrate | 49 |
| Sodium o-sulfobenzimide | 3.6 |
| Sodium allyl sulfonate | 3.7 |
| 1,4-di-(β-hydroxyethoxy)-2-butyne | 0.2 |
| pH | 3.0 |
| Temperature | 55° C. |

Using the Hull Cell test conditions and procedure described in Example 6, a deposit was obtained from the above solution which was bright to brilliant from about 2 asd to the high current density edge of the panel. At a current density of less than about 2 asd there was an iridescent haze.

On adding 95 micromoles per liter (0.024 g/l) of sodium 3,3'-dithiodipropionate to the plating solution and repeating the plating test, the resulting deposit was essentially identical to the previous deposit except that the iridescent haze was no longer present. The overall deposit brightness, however, was diminished somewhat.

The concentration of 1,4-di-(β-hydroxyethoxy)-2-butyne was increased to 0.6 g/l and the above plating test repeated. The resulting deposit was bright to brilliant and completely haze-free across the entire current density range of the panel. In spite of the extremely high concentration (i.e. 0.6 g/l) of Class II brightener (i.e., 1,4-di-(β-hydroxyethoxy)-2-butyne), the deposit was completely ductile and the low current density coverage was excellent; without any evidence of thinness or skip plate.

EXAMPLE 12

An aqueous nickel-iron electroplating bath was prepared having the following composition:

| | Composition in g/l |
|---|---|
| $NiSO_4 \cdot 6H_2O$ | 300 |
| $NiCl_2 \cdot 6H_2O$ | 60 |
| $FeSO_4 \cdot 7H_2O$ | 40 |
| $H_3BO_3$ | 45 |
| Sodium citrate dihydrate | 32 |
| Sodium p-toluenesulfonate | 4 |
| Sodium o-sulfobenzimide | 0.4 |
| Sodium allyl sulfonate | 3.7 |
| Sodium lauryl sulfate | 0.125 |
| 1-(β-hydroxyethoxy)-2-propyne | 0.05 |
| pH | 3.7 |
| Temperature | 55° C. |

A polished brass panel was scribed with a horizontal single pass of 4/0 grit emergy polishing paper to give a band about 1 cm wide at a distance of about 2.5 cm from the parallel to the bottom edge of the panel. The cleaned panel was then plated in a 267 ml Hull Cell, using the above solution, for 10 minutes at 2 amperes cell current, using magnetic stirring. The resulting nickel-iron alloy electrodeposit had poor leveling, was dull, hazy, severely striated and brittle across the entire current density range of the test panel. In addition the low current density range below about 0.6 asd was thin.

On adding 110 micromoles per liter (0.02 g/l) of 2,2'-dithiodiacetic acid to the plating solution and repeating the plating test, the resulting nickel-iron alloy deposit was bright to brilliant across the entire current density range of the test panel. In addition, the deposit was very ductile and free of the striations and dull haze observed before adding the 2,2'-dithiodiacetic acid. The low current density coverage was excellent and the deposit was not thin.

EXAMPLE 1

An aqueous nickel-iron electroplating bath was prepared having the composition listed in Example 11.

Using the Hull Cell test conditions and procedure described in Example 6, a deposit was obtained from the above solution which was bright to brilliant from about 2 asd to the high current density edge of the panel. At a current density of less than about 2 asd there was an iridescent haze.

On adding 408 micromoles per liter (0.125 g/l) of 2,2'-dithiodibenzoic acid (added as an alcoholic solution) to the plating solution and repeating the plating test, the resulting deposit was again bright, but no longer has the iridescent haze noted above.

EXAMPLE 14

An aqueous nickel-cobalt-iron electroplating bath was prepared having the following composition:

| | Composition in g/l |
|---|---|
| $NiSO_4 \cdot 6H_2O$ | 255 |
| $NiCl_2 \cdot 6H_2O$ | 51 |
| $CoSO_4 \cdot 7H_2O$ | 45 |
| $CoCl_2 \cdot 6H_2O$ | 9 |
| $FeSO_4 \cdot 7H_2O$ | 40 |
| $H_3BO_3$ | 45 |
| Sodium citrate dihydrate | 20 |
| Sodium iso-ascorbate | 2 |
| Sodium o-sulfobenzimide | 3.6 |
| Sodium allyl sulfonate | 3.7 |
| 1,4-di-(β-hydroxyethoxy)-2-butyne | 0.2 |
| pH | 3.7 |
| Temperature | 50° C. |

The Hull Cell test procedure and conditions described in Example 1 were employed to obtain a nickel-cobalt-iron alloy deposit from the above solution. The resulting deposit was bright across the entire current density range of the test panel. However, the deposit exhibited a dense blue-grey haze in the region from about 0.8 asd to about 4 asd and a stirring pattern haze was evident in the region from about 4 asd to 10 asd. The deposit was also very brittle.

On adding 330 micromoles per liter (0.065 g/l) of 2,2'-dithiodiacetic acid to the plating solution and repeating the plating test, the resulting nickel-cobalt-iron alloy deposit was bright as before, except that the blue-grey haze and stirring pattern noted above were no longer present. The deposit was also significantly more ductile.

Although this invention has been illustrated by reference to specific embodiments, modifications thereof which are clearly within the scope of the invention will be apparent to those skilled in the art.

I claim:

1. In a process for the preparation of an electrodeposit which contains; at least one metal selected from the group consisting of nickel and cobalt or; binary or ternary alloys of the metals selected from nickel, iron, and cobalt; which comprises passing current from an anode to a cathode through an aqueous acidic electroplating solution containing at least one member selected from nickel compounds and cobalt compounds or compounds providing nickel, cobalt and iron ions for electrodepositing nickel, cobalt, nickel-cobalt alloys, nickel-iron alloys, cobalt-iron alloys or nickel-iron-cobalt alloys, the improvement comprising the presence of 10 micromoles per liter to 2000 micromoles per liter of an organic disulfide compound or salt thereof having the formula:

$$R_1—S—S—R_2$$

wherein $R_1$ and $R_2$ are each independently selected from

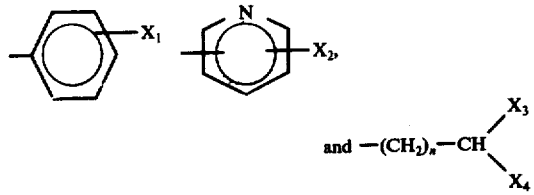

where $n$ is an integer from 0 to 5, $X_1$ and $X_2$ are selected from $—OH$, $—NH_2$,

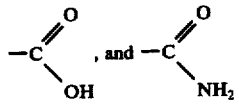

or salts thereof, $X_2$ may additionally be hydrogen and $X_3$ and $X_4$ are each independently selected from —H, —OH, $—NH_2$, and

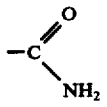

or salts thereof, provided that $X_3$ and $X_4$ are not simultaneously hydrogen; for a time period sufficient to form a metal electroplate upon said cathode.

2. The process of claim 1 wherein said organic disulfide compound is 2,2'-dithiodiethanol.

3. The process of claim 1 wherein said organic disulfide compound is cystamine.

4. The process of claim 1 wherein said organic disulfide compound is 2,2'-dithiodibenzoic acid.

5. The process of claim 1 wherein said organic disulfide compound is 4,4'-dithiodianiline.

6. The process of claim 1 wherein said organic disulfide compound is 4,4'-dithiodipyridine.

7. The process of claim 1 wherein said organic disulfide compound is 6,6'-dithiodinicotinic acid.

8. In a composition for the preparation of an electrodeposit which contains; at least one metal selected from the group consisting of nickel and cobalt or; binary or ternary alloys of the metals selected from nickel, iron, and cobalt; which comprises an aqueous acidic electroplating solution containing at least one member selected from nickel compounds and cobalt compounds or compounds providing nickel, cobalt and iron ions for electrodepositing nickel, cobalt, nickel-cobalt alloys, nickel-iron alloys, cobalt-iron alloys or nickel-iron-cobalt alloys, the improvement comprising the presence of 10 micromoles per liter to 2000 micromoles per liter of an organic disulfide compound or salt thereof having the formula:

$$R_1—S—S—R_2$$

wherein $R_1$ and $R_2$ are each independently selected from

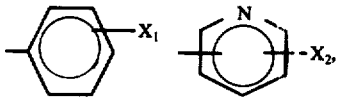

and $—(CH_2)_n—CH(X_3)(X_4)$ where $n$ is an integer from 0 to 5, $X_1$ and $X_2$ are selected from —OH, $—NH_2$,

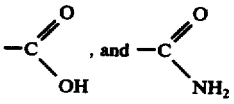

or salts thereof, $X_2$ may additionally be hydrogen and $X_3$ and $X_4$ are each independently selected from —H, —OH, $—NH_2$, and

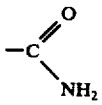

or salts thereof, provided that $X_3$ and $X_4$ are not simultaneously hydrogen.

9. The composition of claim 8 wherein said organic disulfide compound is 2,2'-dithiodiethanol.

10. The composition of claim 8 wherein said organic disulfide compound is cystamine.

11. The composition of claim 8 wherein said organic disulfide compound is 2,2'-dithiodibenzoic acid.

12. The composition of claim 8 wherein said organic disulfide compound is 4,4'-dithiodianiline.

13. The composition of claim 8 wherein said organic disulfide compound is 4,4'-dithiodipyridine.

14. The composition of claim 8 wherein said organic disulfide compound is 6,6'-dithiodinicotinic acid.

* * * * *